United States Patent [19]

Hunt et al.

[11] Patent Number: 4,981,263

[45] Date of Patent: Jan. 1, 1991

[54] PAINT BOOTH THERMAL RECLAMATION SYSTEM FOR SPACE HEATING

[76] Inventors: Thomas C. Hunt, P.O. Box 369, Bainbridge, Ind. 46105; Ronald W. Harris, 3300 Hollywood Ave., Terre Haute, Ind. 47805

[21] Appl. No.: 299,126

[22] Filed: Jan. 23, 1989

[51] Int. Cl.[5] ..... F24F 7/00; B05C 15/00

[52] U.S. Cl. ..... 237/56; 237/50; 98/115.2

[58] Field of Search ..... 98/115.2; 237/50, 53, 237/46, 1 R, 56; 165/35, 39, 59

[56] References Cited

U.S. PATENT DOCUMENTS 3,807,291 4/1974 Roberts ..... 98/115.2

4,367,787 1/1983 Bradshaw ..... 98/115.2

*Primary Examiner*—Henry A. Bennet

*Attorney, Agent, or Firm*—Woodard, Emhardt, Naughton, Moriarty & McNett

[57] ABSTRACT

A paint spray and bake booth has an air heating and circulating system with two blowers and a combination of dampers and ducts which provide different air circulating circuits for the spraying and baking steps. A gas fired furnace with heat exchanging system adds heat directly to the air circulated through the booth to bake paint on a vehicle in it. The heat exchanging system also includes reclamation coils for heat transfer from the circulating air to water in the coils and which is piped to a storage tank for storage of heat over a prolonged period. The storage tank supplies the water through pipes to space heating units in the building in which the paint booth is located. Water is returned from the space heating units to the paint booth heat exchanging system.

10 Claims, 5 Drawing Sheets

PAINT BOOTH THERMAL RECLAMATION SYSTEM FOR SPACE HEATING

BACKGROUND OF THE INVENTION

This invention relates generally to paint booths and more particularly to a system for reclaiming and distributing heat from such a booth for overall energy conservation.

DESCRIPTION OF PRIOR ART

The application of protective coatings to the surfaces of products is often done in so-called "paint booths". Where the product to be coated is a vehicle, as in an automotive body and paint shop, the booth is relatively large in size in order to accommodate the entire vehicle and an individual workman or workmen moving about in the booth as they spray paint a vehicle. The booth is provided with a system for collecting overspray and maintaining some level of cleanliness in the air. Some such booths also are provided with equipment for raising the atmospheric temperature in the booth following the spraying operation, to "bake" the paint on the vehicle.

Where a paint booth is provided with heating equipment for the paint curing step, relatively large amounts of heat are required to provide a temperature in the booth of between 120 and 160 degrees Fahrenheit. An air circulating system is provided to circulate hot air through the booth, and the various types of arrangements are provided to heat the air to maintain the air temperature in the booth within the above-mentioned range.

When the bake cycle is finished, the hot air is exhausted to atmosphere so the temperature can be reduced to accommodate entry of workmen for touch up, or any other steps to finish the operation, and then remove the vehicle from the booth. As hot air is exhausted from the booth to the surrounding atmosphere by the exhaust system, make-up air may enter the booth from the area within a heated building in which the booth is located, whether the booth be a stand alone structure, or a part of the building structure itself. In any case, this requires heating of the air in the building space if reasonable working temperatures are to be maintained in the building in a cold climate, thus consuming more energy for space heating purposes. Also, if the booth is to be later used for baking paint on another vehicle, heat must be added again to the air to be circulated in the booth, in order to raise the temperature adequately for the curing operation. The result is a very substantial consumption of energy to adequately heat the air in the booth and maintain the proper curing temperatures therein, plus any additional heat required for space heating in the area around the booth for the make-up air needed as the excessively hot air from the booth is discharged to atmosphere after the curing cycle.

Our invention is directed toward conservation of energy in establishments employing a paint booth.

SUMMARY OF THE INVENTION

Described briefly, according to a typical embodiment of the present invention, air circulating systems are provided for a paint booth and which employ two blowers and a combination of dampers and ducts which provide different air circulating circuits for the spraying and baking steps. A heat exchanging system is employed which uses a furnace to add heat directly to the air circulated through the system for raising the temperature for the curing cycle, but also enables transfer to a medium suitable for storage of heat over a prolonged period for subsequent use in a space heating system for the building with which the paint booth is associated.

DESCRIPTION OF THE PREFERRED EMBODIMENT

Figure 1:
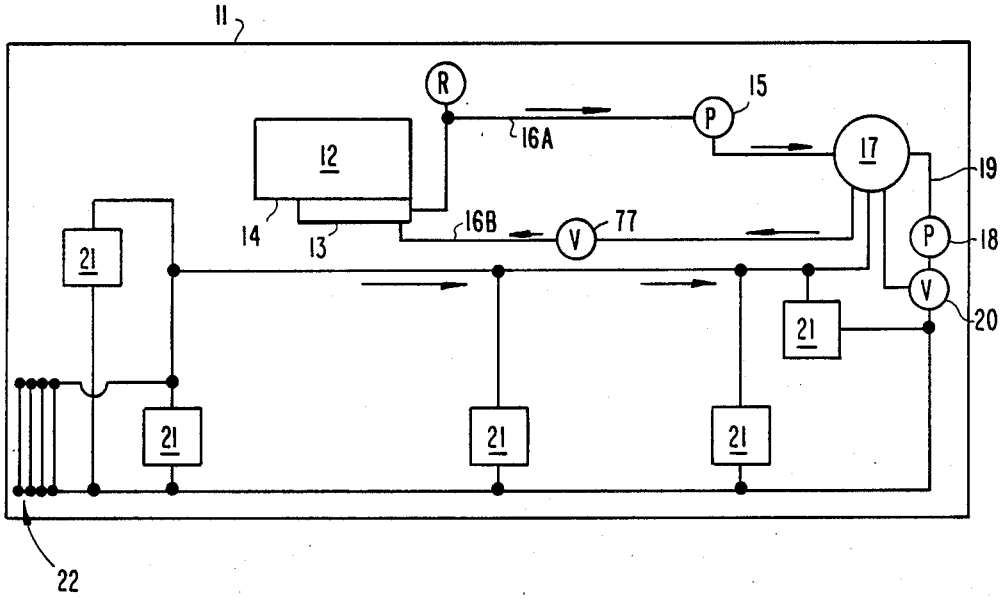
FIG. 1 is a schematic diagram of a building with a system incorporated therein according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, particularly FIG. 1, a body and paint shop building 11 is shown schematically and should be understood to have therein the usual areas and equipment for the necessary cutting, welding, bending, straightening, sanding, parts and equipment and material storage, and offices. In addition, there is the paint booth 12 with the air circulating equipment 13 at the wall 14 thereof. The booth may be fourteen feet wide and twenty-four feet long, for example. According to one important feature of this invention, there is a heat reclamation system. The example shown includes a pump 15 taking hot water through line 16A from the equipment 13 and delivering it to an insulated storage tank 17. Several tanks connected in parallel would also be suitable. A pump 18 takes hot water through line 19 from the storage tank 17 and delivers it through three-way valve 20 to heat exchanging, air handling space heater units 21 spaced throughout the building, and to radiant heater tubes 22 which are for space-heating purposes.

Figure 2:
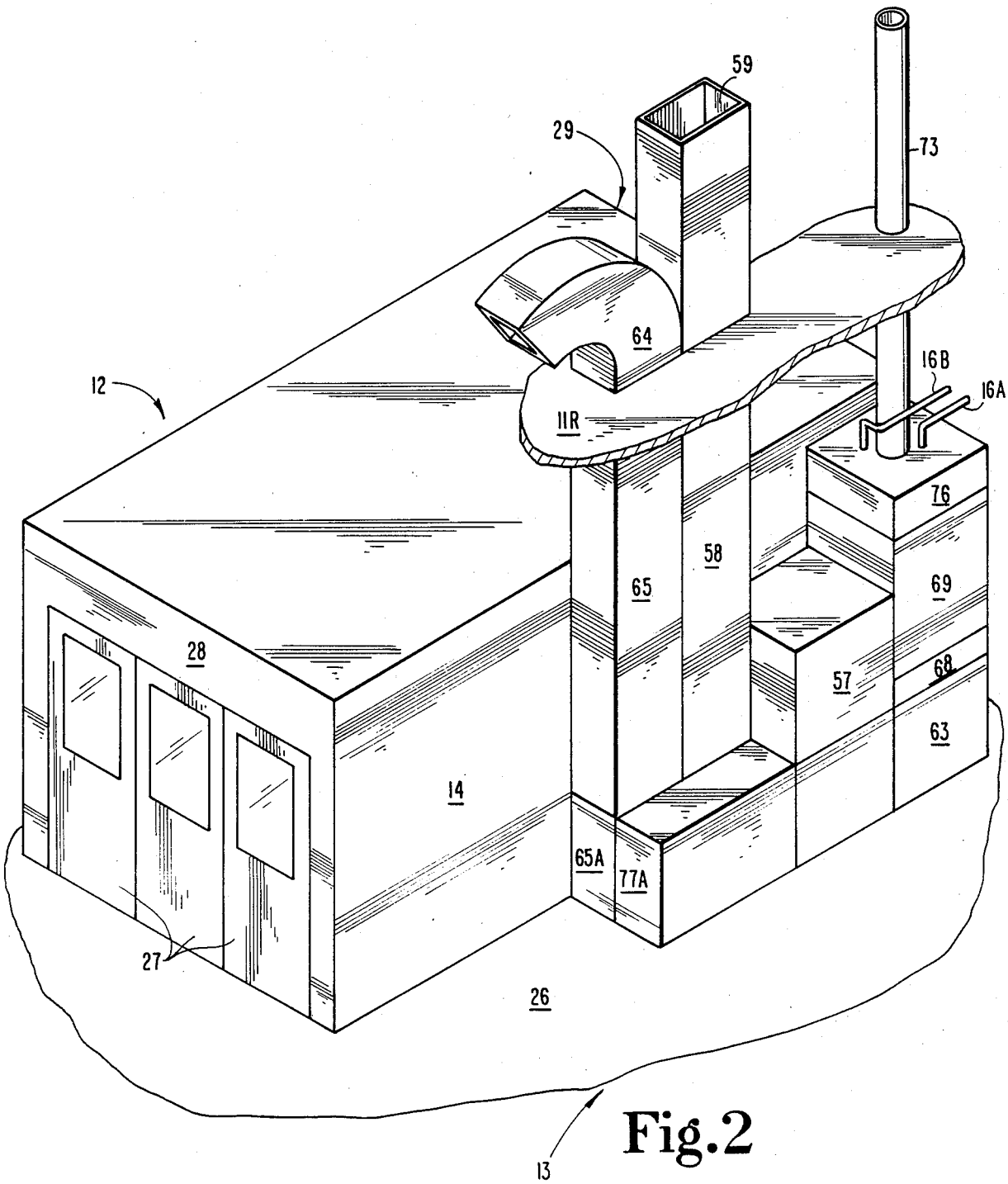
FIG. 2 is a pictorial view (partially cut-away), and showing the paint booth itself and the air circulating system.
Figure 3:
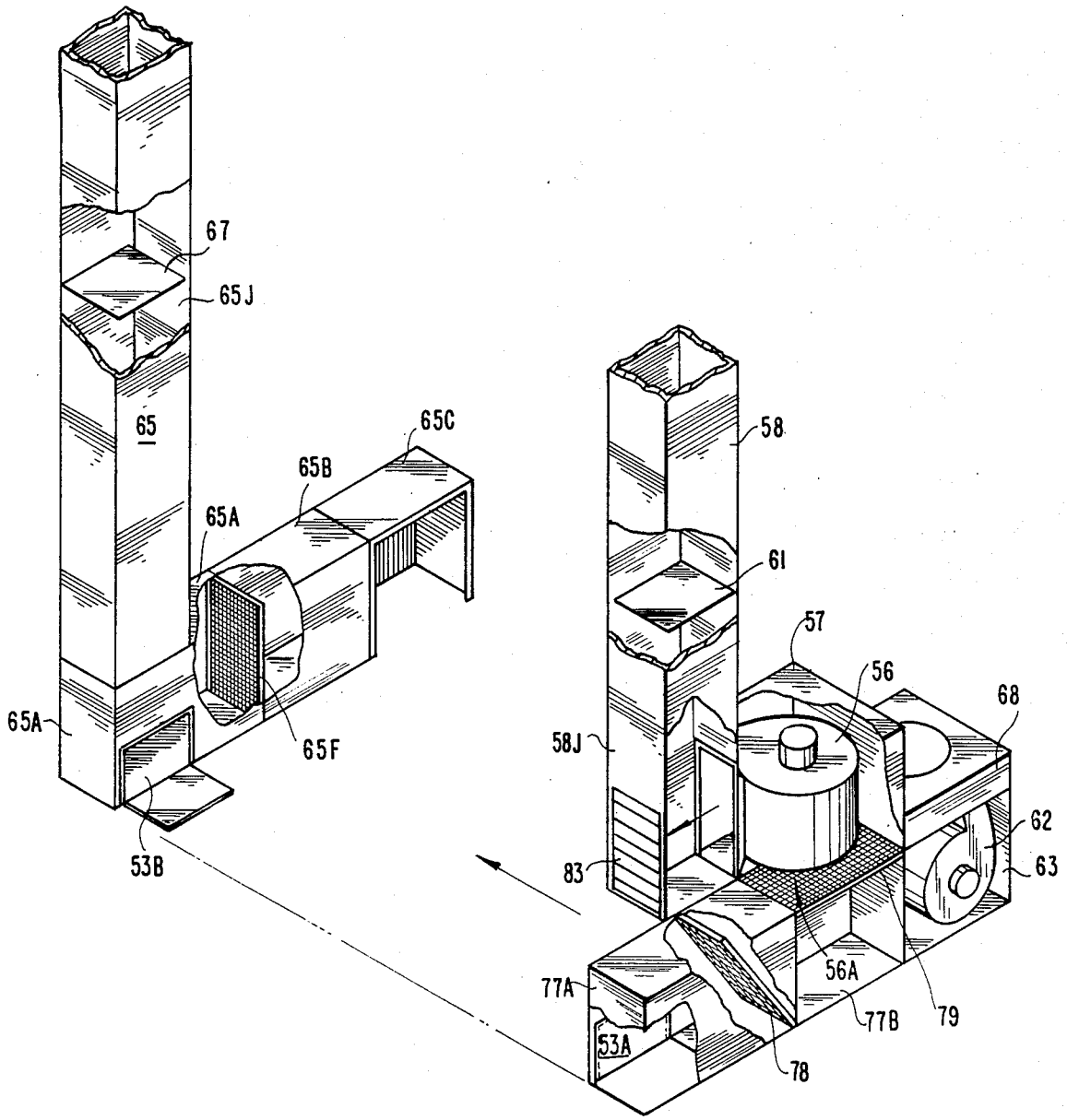
FIG. 3 is a pictorial view partially exploded and partially cut-away, of the above ground cabinetry, ductwork and blowers for air supply and exhaust for the booth.
Figure 4:
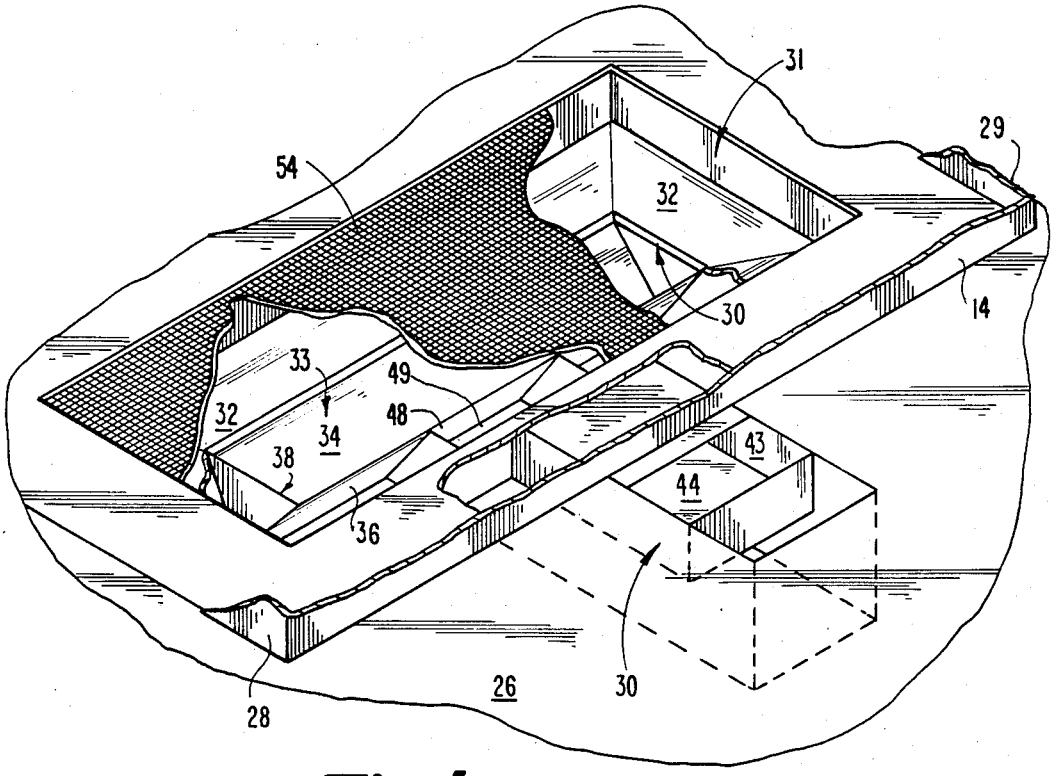
FIG. 4 is a pictorial view similar to FIG. 2 but showing the in-ground portion of the air circulating system.

Referring now to FIGS. 2 through 4, the paint booth 12 is shown mounted on floor 26 and has three entrance doors 27 at the front end 28. It can also have doors at the rear end 29, if desired, depending upon the layout of the building and the location of the booth in it. The air handling equipment for the booth is provided at the wall 14.

Figure 5:
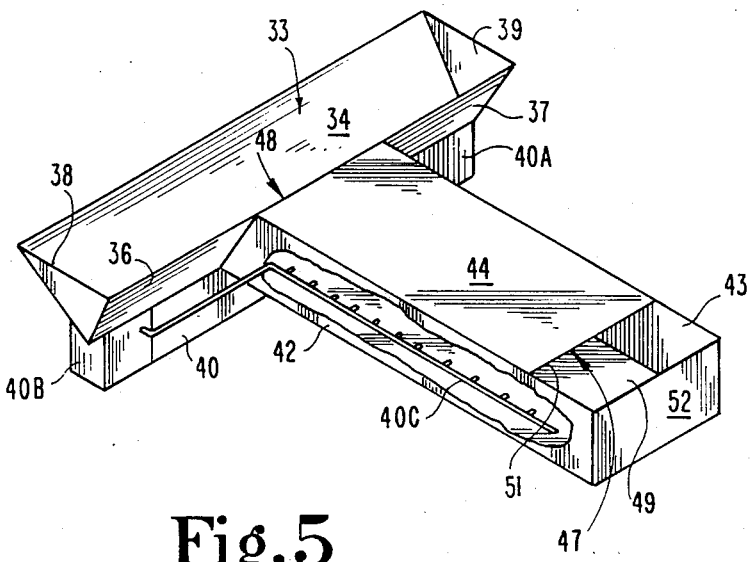
FIG. 5 is a pictorial schematic diagram of that portion of the in-ground pit and air passageways that is in air circulation service during the paint spraying cycle of use of the booth.

The locations of the aforementioned walls on the floor 26 are shown fragmentarily in FIG. 4, where a hole 30 is shown in the floor immediately outside the booth wall 14. A catch basin 31 is shown in the floor 26 inside the booth. Its floor 32 slopes slightly downward (about 4°) toward a central opening which is at the top of a pit 33. As shown schematically in FIGS. 4 and 5, this pit is Y-shaped, having the outside wall 34, inside wall 36, both of which converge to the bottom 37, the pit having front and rear end walls 38 and 39, respectively. The "stem" or trunk of the Y serves as sump 40 between two pump/filter stations 40A and 40B at opposite ends of the sump.

Figure 6:
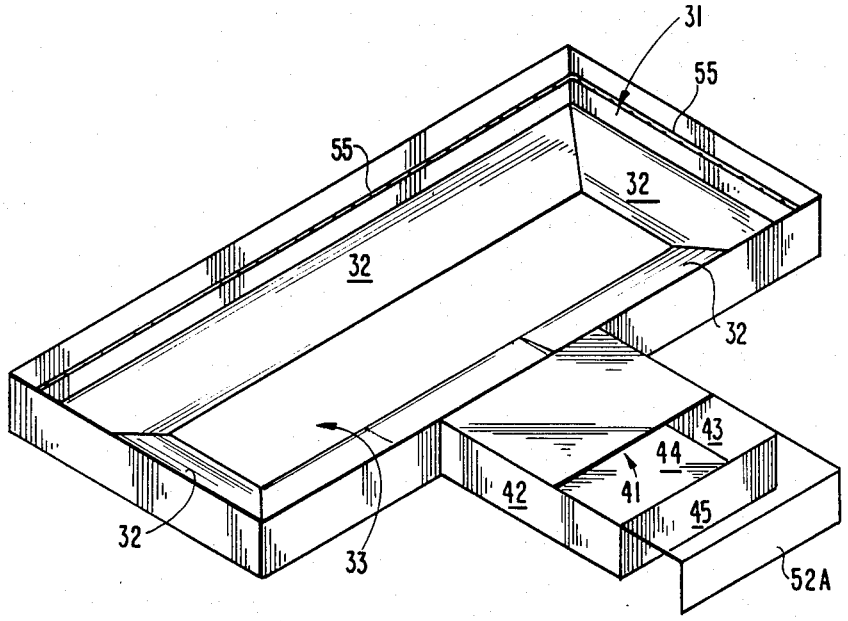
FIG. 6 is a pictorial schematic diagram of that portion of the in-ground pit and air passageway that is in air circulation service during the paint baking cycle of use of the booth.
Figure 7:
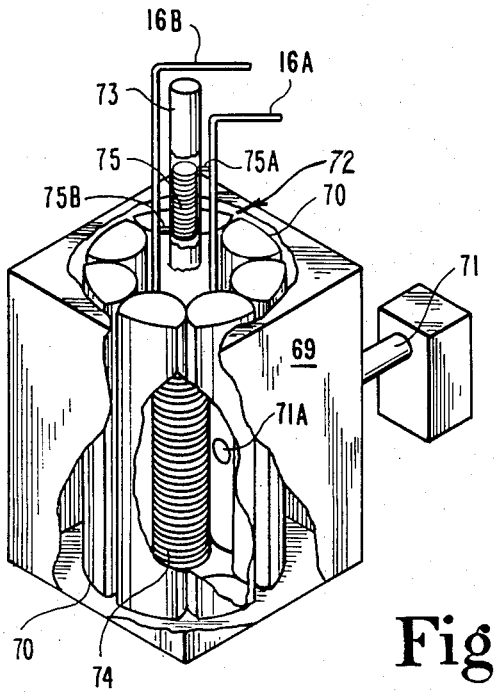
FIG. 7 is a pictorial view, partially cut away, of the heat exchanger assembly of the illustrated embodiment of the present invention.

In FIG. 4, where the dirt or gravel under floor 26 is omitted from the drawing, there is shown a passageway 41 between vertical front and rear walls 42 and 43, respectively, and which opens through the catch basin wall into the catch basin 31. As shown in FIG. 4, and discernable upon comparing FIGS. 5 and 6, the floor 44 of this passageway is at a level about half the depth from the floor top surface 26, to the bottom 37 of the pit. There is an additional passageway 47 between walls 42 and 43 and under this floor and which communicates with pit 33 through a rectangular opening 48 in pit wall 36. This opening is bounded by the vertical walls 42 and 43, the horizontal partition wall or floor 44 and the bottom wall or floor 49. Floor 44 terminates at an edge 51, while floor 49 terminates at a vertical wall 52 extending up toward the floor 26 and meeting plate 52A mounted to the catch basin ductwork and hanging down from the surface of floor 26 to meet wall 52.

A steel grating 54 is mounted to the top of the catch basin 31 and is strong enough to support the vehicle being treated. The sump may be provided with a collector and/or separator system for any paint that may accumulate in it during a paint spray cycle, and a drain to sewer to permit scrubbing down of the floor of the paint booth and draining dirty water and the like from the pit. A perimeter water pipe 55 with longitudinally spaced water outlets is located at the outside wall of the catch basin all the way around it to sheet water onto the catch basin floor during spraying of paint. This pipe may be supplied by recirculating pump at station 40A under the pit at one end of the sump. Similarly, the pump at station 40B at the opposite end of the sump supplies water to pipe 40C extending the length of passageway 47 to provide a water spray across this passageway. The floor 49 of this passageway slopes down toward sump 40 at 4° so sprayed water and any paint thereby separated from air in the passageway, flows back to the sump. Each of the stations 40A and 40B has a filter to separate collected paint from the recirculating water for the sheeting system in the catch basin and the spraying system in passageway 47.

An L-shaped damper 53 is hinged at 51 to the catch basin frame structure at the center of the floor opening frame portion thereof so that, when the catch basin frame is in place in the floor, and floor opening 30 is properly framed, the damper is pivotable about a horizontal axis at the level of the top of floor 26. It is pivotable from the position shown by the dotted lines 53A in FIG. 3 when the system is in the spray mode of operation, to the position shown by the solid line 53B when the system is in the bake mode.

The air handling system for the paint booth according to the present invention includes two primary air movers. One is an exhaust blower 56 in a plenum 57 at wall 14 of the booth and discharging through the duct 58 to stack 59 outside the building. An electrically controlled damper 61 is in this exhaust stack. A supply blower 62 is located in the plenum 63 at the side wall 14 of the booth and has two alternate sources of intake air. One source is from an intake stack 64 through the roof of the building and through duct 65 to the fresh air intake duct components 65A, 65B and 65C into the plenum 63, for drawing in outside air. An electrically controlled damper 67 is located in the stack 64. Blower 62 can also take air from catch basin 31 through the passageway 41 and through the inboard portion of the floor opening 30 when the floor damper 53 is at its clockwise limit as shown in the solid line 53B in FIG. 3 and into duct components 65A, 65B and 65C to the plenum 63. The blower 62 takes air from duct cabinet portion 65C and blows it through a transition box 68 and up through the circular opening at the top of box 68 into a heat exchanger assembly in heat exchanger cabinet 69 containing a circular array of vertical tubes 70 comprising a heat exchanger "cylinder" 72 whose outer circular dimension corresponds to the circular outlet of the box 68.

A gas burner tube 71 proJects into this heat exchange cylinder 72, opening at 71A near the center, to heat air as it passes up through the vertically extending tubes 70 arranged continuously in a circle, the outer walls of the tubes forming the cylinder 72. The combustion products escape through the flue stack 73 which extend up through the roof to the atmosphere outside the building 11. A heat reclaiming coiled tube 74 is provided in the open center of the heat exchanger cylinder 72 and is coupled through the pipes 16A and 16B to the storage tank 17 (FIG. 1). An additional heat reclaiming coiled tube 75 is located in flue 73 and is connected at its upper and lower ends to tubes 16A and 16B, respectively, at 75A and 75B.

The air tubes 70 of the heat exchanger cylinder open at the top into plenum/duct 76 which opens through the paint booth wall 14 just under its roof, whereby blower 62 delivers hot air to the booth. This air can be directed however desired within the booth to best dry the paint on a vehicle in it. A wash down curtain wall or walls or whatever else might be desired can be used to encourage the collection of overspray and mist in the bottom of the sump 40.

Bake Cycle

Since an important feature of the invention is the thermal reclamation, the paint bake cycle will be described first. The damper 53 is put in the position shown at 53B in FIG. 3, preventing flow of air from the pit up through the outboard half of opening 30 into transition duct 77A. The exhaust blower 56 is off. The gas burner control is set for the desired temperature (somewhere between 105° F. and 175° F.) in the booth, to deliver heat to the air being delivered to the paint booth by the blower 62. With the damper 53 in position 53B in FIG. 3, and considering the location of the outer end wall 45 of passageway 41 from the catch basin 31, directly under the pivot axis of damper 53, the air is circulated only through the upper passageway 41 from the catch basin. The damper 67 is closed in the intake duct 65 as is the damper 61 in the exhaust duct 58. Consequently, during the bake cycle, all of the air is recirculated through the booth from the catch basin through passageway 41, duct portions 65A, 65B, 65C, blower 62, heat exchanger tubes 70, header 76, and back to the booth. A filter 65F in the inlet end of cabinet 65B filters all of this recirculating air. In this way, the temperature in the environment in the booth is raised to the desired level for curing, typically between 105° F. and 175° F. This continues as long as is needed for proper curing of the paint. The heat input at the burner tube 71 can be as much as one million BTU's per hour.

When it is no longer needed to maintain the high temperature in the curing booth, the furnace can be shut off by a thermostat sensing air temperature in the booth. Then the valves 77 can be opened and the pump 15 operated to pump water from the heating coils 74 and 75 through the pipe 16A into the storage tank 17. Consequently, the temperature of the water in the storage tank will rise. Pump 18 can be operated to pump this water throughout the rest of the system and deliver it through space heaters 21 and radiant heaters 22. This operation will take heat from the air being circulated through the booth and deliver it for storage in the storage tank 17. As the water continues to flow through the system, the temperature level of water in the storage tank increases. Consequently, that available for radiant heating can be used as needed by control of the pump 18 and/or the three-way by-pass valve 20. Control of the water flow through the individual space heaters can be handled by individual valves associated with them. If the space heating requirements are less than the total energy to be absorbed to cool down the air in the paint booth, pump 18 can be shut off, or valve 20 switched to by-pass the space heating water circulating system. Pump 15 can remain on, and valve 77 can remain open to permit continued circulation of water through the reclamation coils 74 and 75, and the temperature of the water in the storage tank 17 will continue to rise as heat is added from the reclamation coils. Thus, a heat sump is provided according to the present invention for utilization for the space heating needs whenever desired. It should be understood, of course, that the hot water stored in the tank 17 can be used for other purposes, if desired. Pressure relief valve R (FIG. 1) is provided for safety.

When a bake cycle has been completed, some amount of cool down will occur automatically if the reclamation system is using the heat. Essentially all of the heat can be used by the reclamation system, for total cool down, if desired. But if the weather is warm, the dampers 61 and 67 can be opened, and damper 53 switched 90° counterclockwise to the position 53A (FIG. 3). Blower 56 is turned on and pulls air from pit passageway 47, through duct part 77A, filter 78 therein, filter cabinet outer half 77B and up through filter 79 at the top of 77B, and into the blower intake 56A. The blower has a vertical axis and discharges in the direction of arrow 82 into the lower end of duct 58 from which it exits up through stack 59 into atmosphere outside the building roof 11R. Outside air enters stack 64, duct 65, 65A, 65B, 65C, blower 62, and is discharged thereby through tubes 70 (now unheated) and plenum 76 into the booth.

Spray Cycle

Now that the bake cycle, and cool down methods have been described, the paint spray cycle will be described. The air flow arrangement is slightly different, depending on whether outside temperature is above or below 75° F.

Ambient Above 75° F.

When the outside temperature is above 75° F., all dampers are situated as in the above-mentioned warm weather cool down cycle. Thus, the air circulation is the same. But water is turned on to the pipes 55 in the catch basin and 40C in the passageway 47. This can be done by pumping from the sump, if there is water clean enough therein. Otherwise fresh water can be supplied to these tubes from water mains. Thus, the water wash down in the catch basin, and spray in passageway 47 are intended to prevent movement of paint mist and solids into the intake transition duct 77A. Filters 78 and 79 prevent discharge of contaminants to atmosphere. Filter 79 may be a charcoal filter, for example.

Ambient Below 75° F.

The dampers are arranged as for the above 75° F. spray cycle but, if the outside air is too cold, dampers 61 and 67 may be partially closed. Both blowers are on.

The booth thermostat is adJusted for the desired temperature, and will control the burner accordingly. But heat can be conserved in this mode by opening the shutters 83 and permitting air pulled from pit passageway 47, after filtering at 78 and 79, to be pushed from the bottom of exhaust duct 58 directly to the bottom of intake duct 65, as these shutters are in aligned openings in the adJoining walls 65J and 58J of these ducts. The air is taken from the bottom of duct 65 through ducts 65A, B, C, blower 62 and pushed up through tubes 70, plenum 76 and into the booth. Thus, most of the air is recirculated, depending on the extent of opening of shutters 83.

As can be appreciated upon inspection of FIG. 3, there is some small horizontal space from the dampers 67 and 61 to the walls 65J and 58J respectively, of these ducts. Since these walls touch each other, there is some heat exchange between them as a small amount of fresh air enters duct 65 and a like amount of warm air from blower 56 departs from duct 58. Thus, there is some pre-heating of the fresh air that enters, by the air that exits along the adJoining walls of the ducts, as dictated by the location of the spaces between the dampers and their respective duct walls, even when the dampers are fully closed. During this "below 75°" cycle, water is to be used in the tubes 55 and 40C in the same way as in the "above 75°" cycle.

For all of the cycles, the control of dampers and shutters can be powered, and handled by automatic control to the extent desired for optimum performance.

From consideration of FIGS. 2 and 3 in the light of the foregoing description, it can be appreciated that the present invention enables modular construction for a paint booth. Duct components 65A and 77A can actually be provided by a single cabinet four feet high, four feet wide and six feet long, divided by vertical partition extending lengthwise down the middle and having the cut out in it to accommodate damper 53. Components 65B and 77B can be a single cabinet which is 4×4×4 feet, with a partition down the middle, providing separated intake air passageways for the two blowers. Components 65C and 63 can be a single 4×4×4 cabinet, with part of the top open for discharge of air from blower 62 into the transition box 68. The cabinet 57 is 4×4×4. The ducts 58 and 65 are 2×2 in cross section, but could be a single tube with central longitudinal partition having an opening in it to accommodate the shutters 83. The heat exchanger cabinet is 4×4×4 and can accommodate the indirect firing approach as described above, or a direct firing (furnace combustion products entering the air flow to the plenum 76) approach. As a result of this modular construction, the air circulating system can be employed on either side of the booth. Also the catch basin, pit, sump and in-ground passageway arrangement lend themselves readily to pre-fabricated sheet metal construction, useful in form work prior to pouring concrete for the sub-structure and floor slab. The reclamation system can be employed with other types of paint booths such as Spraybake, Lutro and Binks, for example, locating the reclamation coils where most convenient and where they can pick up heat continuously both during the bake cycle (if desired) and during the cool down cycle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. In combination with a building having interior habitable space and heating requirements for the habitable space, a building heating system comprising:

a paint curing booth sufficiently large to accommodate a motor vehicle therein;

an air moving system associated with said booth to establish and maintain a flow of air through the booth;

heat exchanging means associated with said air moving system to add heat to the flowing air to raise the temperature of the air to enhance curing of paint on an object in the booth;

heat reclamation means associated with the air moving system to collect heat from heated air flowing through the booth;

a fluid transfer circuit including said heat reclamation means therein;

space heating means including heat transfer means therein coupled to said fluid transfer circuit to take heat from fluid flowing in said circuit and transfer the heat to breathable air in the habitable space in the building for heating said habitable space.

2. The heating system of claim 1 and wherein:

said heat reclamation means include heat exchanger tubing in said heat exchanging means, said fluid being water flowing through said tubing.

3. The heating system of claim 2 and wherein said heat exchanging means include air conveying tubes of said air moving system, the heating system further comprising:

gas burner means coupled to said heat exchanging means for delivering hot combustion gases to said air conveying tubes.

4. The heating system of claim 2 and further comprising:

a water storage tank in said fluid transfer circuit to receive hot water from said heat exchanger tubing to elevate the temperature of water stored in said tank; and a second fluid transfer circuit connected to said storage tank and including therein said heat transfer means receiving hot water from said storage tank to extract heat from the water and transfer it to the air in the habitable space in the building.

5. The heating system of claim 4 and wherein:

each of said circuits includes a pump for pumping hot water through the respective circuit.

6. The heating system of claim 1 and further comprising:

a pit in the floor of said booth;

a first passageway in the air moving system and extending from a location near the bottom of said pit to enable removal of air from the booth through the pit;

a second passageway in the air moving system and communicating with the pit at a level near the top of the pit to take air from the booth at a level immediately below the floor of the booth; and a damper associated with said passageways and operable between positions controlling whether the air is taken from the pit through the first passageway or the second passageway.

7. The heating system of claim 6 and wherein the air moving system further comprises:

heat exchanger air supply ductwork including an outdoor air intake duct, a first transition duct, a first filter duct, and a first blower intake plenum in series;

a first blower having an inlet coupled to said plenum and having an outlet coupled to said heat exchanging means to deliver air from outdoors through said heat exchanging means; and discharge ductwork coupled to said heat exchanging means and to said booth above the floor of said booth to deliver heated air from said heat exchanging means into said booth.

8. The heating system of claim 7 wherein the air moving system further comprises:

exhaust ductwork including a second transition duct communicable with said first passageway, and a second filter duct;

a second blower having an inlet coupled to said second filter duct and having an outlet; and an exhaust duct extending from said second blower outlet and having a discharge stack outside the building.

9. The heating system of claim 8 wherein:

said outdoor intake duct and said exhaust duct have a common wall with a shuttered opening therein, the shuttered opening being selectively operable to provide or preclude communication between said intake duct and said exhaust duct.

10. The heating system of claim 9 wherein:

said intake duct and said exhaust duct have dampers therein on the portions of the intake and exhaust ducts on the side of said shuttered opening opposite the trans ducts.

* * * * *